US010301886B2

(12) United States Patent
Walker et al.

(10) Patent No.: US 10,301,886 B2
(45) Date of Patent: May 28, 2019

(54) DRILLING RISER ASSEMBLIES

(71) Applicants: Stephen J. Walker, Houston, TX (US); Gilbert Nance, Houston, TX (US); Randy Arthion, Houston, TX (US); AMERIFORGE GROUP INC., Houston, TX (US)

(72) Inventors: Stephen J. Walker, Houston, TX (US); Gilbert Nance, Houston, TX (US); Randy Arthion, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 14/776,674

(22) PCT Filed: Mar. 12, 2014

(86) PCT No.: PCT/US2014/024313
§ 371 (c)(1),
(2) Date: Sep. 14, 2015

(87) PCT Pub. No.: WO2014/150816
PCT Pub. Date: Sep. 25, 2014

(65) Prior Publication Data

US 2016/0032662 A1 Feb. 4, 2016

Related U.S. Application Data

(60) Provisional application No. 61/791,222, filed on Mar. 15, 2013.

(51) Int. Cl.

| | |
|---|---|
| ***E21B 17/04*** | (2006.01) |
| ***E21B 17/01*** | (2006.01) |
| ***E21B 17/08*** | (2006.01) |

(52) U.S. Cl.
CPC ..... *E21B 17/04* (2013.01); *E21B 17/01* (2013.01); *E21B 17/085* (2013.01)

(58) Field of Classification Search
CPC ..... E21B 17/04; E21B 17/01; E21B 17/085
(Continued)

(56) References Cited

U.S. PATENT DOCUMENTS 1,363,504 A * 12/1920 Flynn ..... F16B 39/02 411/140
2,940,779 A 6/1960 Buono ..... 285/114
(Continued)

OTHER PUBLICATIONS

Extended European Search Report for EP 14769570.4 dated Sep. 27, 2016.

(Continued)

*Primary Examiner* — Anna M Momper
*Assistant Examiner* — Patrick F Lambe
(74) *Attorney, Agent, or Firm* — Norton Rose Fulbright US LLP

(57) ABSTRACT

A riser assembly is disclosed comprising: a main tube; two flanges coupled to the main tube, each flange comprising: a central lumen configured to be in fluid communication with the main tube; at least one choke/kill hole configured to receive a choke/kill line; at least one booster hole configured to receive a booster line; and a plurality of bolt holes, each bolt hole comprising a tapered portion and a dowel slot, where each bolt hole is configured to receive a nut, a bolt, and a dowel. In certain embodiments, riser strings comprising at least two riser assemblies coupled to each other are disclosed.

18 Claims, 6 Drawing Sheets

(58) Field of Classification Search
USPC ..... 166/367
See application file for complete search history.

(56) References Cited

U.S. PATENT DOCUMENTS

| | | | | |
|---|---|---|---|---|
| 3,135,538 | A | 6/1964 | George | 285/363 |
| 3,848,421 | A | 11/1974 | O'Brien et al. | 61/72.3 |
| 4,043,575 | A | 8/1977 | Roth | 285/90 |
| 4,183,562 | A | 1/1980 | Watkins | 285/405 |
| 4,199,847 | A | 4/1980 | Owens | 24/249 |
| 4,288,105 | A | 9/1981 | Press | 285/55 |
| 4,330,140 | A | 5/1982 | Hampton | 285/39 |
| 4,478,287 | A | 10/1984 | Hynes et al. | 166/341 |
| 4,487,434 | A | 12/1984 | Roche | 285/93 |
| 4,550,936 | A | 11/1985 | Haeber et al. | 285/26 |
| 4,573,714 | A * | 3/1986 | Sweeney | F16L 39/00 285/114 |
| 4,606,557 | A | 8/1986 | Coffey | 285/18 |
| 4,620,731 | A | 11/1986 | Rushing | 285/363 |
| 4,712,620 | A | 12/1987 | Lim et al. | 166/355 |
| 4,865,356 | A | 9/1989 | Moore et al. | 285/55 |
| 4,919,391 | A | 4/1990 | Kemp | 251/148 |
| 5,029,647 | A | 7/1991 | Milberger et al. | 166/367 |
| 5,230,540 | A | 7/1993 | Lewis et al. | 285/363 |
| 5,377,763 | A | 6/1995 | Pearce et al. | 166/367 |
| 5,423,575 | A | 6/1995 | Parks | 285/133.1 |
| 5,441,311 | A | 8/1995 | Watkins | 285/18 |
| 5,474,132 | A | 12/1995 | Gallagher | 166/367 |
| 5,713,607 | A | 2/1998 | Webb | 285/133.1 |
| 5,899,507 | A | 5/1999 | Schroeder et al. | 285/343 |
| 6,176,663 | B1 | 1/2001 | Nguyen et al. | 411/368 |
| 6,231,265 | B1 | 5/2001 | Rytlewski et al. | 403/322.1 |
| 6,361,085 | B2 | 3/2002 | Nguyen | 285/368 |
| 6,415,867 | B1 | 7/2002 | Deul et al. | 166/367 |
| 6,419,277 | B1 | 7/2002 | Reynolds | 285/123.1 |
| 6,554,072 | B1 | 4/2003 | Mournian et al. | 166/355 |
| 6,615,922 | B2 | 9/2003 | Deul et al. | 166/367 |
| 6,860,525 | B2 | 3/2005 | Parks | 285/391 |
| 7,188,677 | B2 | 3/2007 | Moe | 166/355 |
| 7,219,739 | B2 | 5/2007 | Robichaux | 166/355 |
| 7,467,914 | B2 | 12/2008 | Finn et al. | 405/224.3 |
| 7,913,767 | B2 | 3/2011 | Larson et al. | 166/380 |
| 7,926,593 | B2 | 4/2011 | Bailey et al. | 175/87 |
| 7,988,104 | B1 | 8/2011 | Cook et al. | 248/68.1 |
| 8,172,279 | B2 | 5/2012 | Webjorn | 285/412 |
| 2002/0134553 | A1 | 9/2002 | Woodrow | 166/367 |
| 2005/0129457 | A1 | 6/2005 | Webjorn | 403/183 |
| 2010/0164223 | A1 | 7/2010 | Curtiss, III et al. | 285/24 |
| 2010/0178709 | A1 | 7/2010 | Chandler et al. | 428/403 |
| 2010/0221702 | A1 | 9/2010 | Moser | 435/6.12 |
| 2010/0314865 | A1 | 12/2010 | Hatton et al. | 285/187 |
| 2011/0042095 | A1 | 2/2011 | Sessions et al. | 166/360 |
| 2011/0073315 | A1 * | 3/2011 | Guesnon | E21B 17/085 166/367 |
| 2011/0109081 | A1 | 5/2011 | Baugh | 285/148.28 |
| 2011/0304138 | A1 | 12/2011 | Commoner | 285/368 |
| 2012/0164627 | A1 | 6/2012 | Battrell et al. | 435/5 |
| 2013/0043036 | A1 | 2/2013 | Kotrla et al. | 166/345 |

OTHER PUBLICATIONS

International Search Report and Written Opinion Issued in PCT/US2014/024313, dated Jul. 10, 2014.

* cited by examiner

DRILLING RISER ASSEMBLIES

This application is a national phase application under 35 U.S.C. § 371 of International Application No. PCT/US2014/024313, filed Mar. 12, 2014, which claims the benefit of priority to U.S. Provisional Patent Application Ser. No. 61/791,222, filed Mar. 15, 2013, the contents of each of which are hereby incorporated by reference in their entirety.

FIELD OF THE INVENTION

This invention relates riser assemblies for use in offshore drilling operations. In particular, this invention relates to flanged connections between riser assemblies.

BACKGROUND

Flanged connections have a wide variety of industrial uses including connecting structural members that will be subjected to critical external loads and in sealing high pressure vessels. The flanges used in such applications must be maintained in face-to-face contact to ensure proper operation. This face-to-face contact is maintained by the plurality of fasteners that are tightened to a high percentage of their yield strength. It is well known in the art that such flanges bend in an axial or meridional direction during this tightening procedure. This meridional bending is transmitted to the fasteners, contributes significantly to the stress in the fasteners, and reduces the amount of tightening to which the fasteners can be safely subjected. As a consequence, the bending reduces the face-to-face contact between the flanges and therefore also the load to which the flanged connections can be subjected.

Flanged connections play a particularly significant role in the oil and gas industry where large diameter tubular members with flanged end connections, called "risers" or "riser joints," are used. These risers are used in offshore drilling and production operations and extend from the wellhead at the ocean floor to a surface vessel. A drawback of conventional flanged connections that is specific to risers is that flanged connections often dictate the manner in which risers are connected, commonly referred to as either "pin up" or "box up." Conventional flanges are designed to either be a bottom flange or a top flange, and are designed to either connect risers in a pin up or a box up configuration, but not both. As a consequence, this lack of robustness from conventional flanged connections hinders riser connection innovation. Because flanged connections between adjacent riser joints must contain internal pressure along with enormous external loads due to environmental conditions, it is critical that these flanged connections, and the fasteners holding them together, function flawlessly and enable innovative riser connection designs.

SUMMARY

Riser assemblies and riser strings are disclosed. In one embodiment, a riser assembly is disclosed comprising: a main tube; two flanges coupled to the main tube, each flange comprising: a central lumen configured to be in fluid communication with the main tube; at least one choke/kill hole configured to receive a choke/kill line; at least one booster hole configured to receive a booster line; and a plurality of bolt holes, each bolt hole comprising a tapered portion and a dowel slot, where each bolt hole is configured to receive a nut, a bolt, and a dowel.

In another embodiment, the riser assembly further comprises a plurality of bolts; a plurality of slick nuts equal in number to the plurality of bolts, where each nut comprises: a cylindrical section comprising an outer surface; a tapered section; and a shoulder between the cylindrical section and the tapered section; where each nut further comprises a slot in the outer surface; and a plurality of dowels equal in number to the plurality of nuts.

In some embodiments, the riser assembly further comprises: a plurality of threaded nuts equal in number to the plurality of bolts, where each nut comprises: a cylindrical section comprising an outer surface; a tapered section; and a shoulder between the cylindrical section and the tapered section; where each nut further comprises a slot in the outer surface; and a plurality of dowels equal in number to the plurality of nuts.

In specific embodiments, the riser assembly comprises six bolts or six nuts.

In some embodiments, the riser assembly comprises a choke/kill line coupled to each flange such that the choke/kill line is received in a choke/kill hole of each flange. In other embodiments, the riser assembly comprises a booster line coupled to each flange such that the booster line is received in a booster hole of each flange.

In some specific embodiments, the riser assembly further comprises a bracket configured to support at least one choke/kill line and at least one booster line; at least one choke/kill line supported by the bracket and coupled to each flange such that the choke/kill line is received in a choke/kill hole of each flange; and at least one booster line supported by the bracket and coupled to each flange such that the booster line is received in a booster hole of each flange.

In another embodiment, a riser string is disclosed comprising: a first riser assembly comprising: a first main tube; a first flange coupled to the first main tube, the first flange comprising: a central lumen configured to be in fluid communication with the main tube; at least one first choke/kill hole configured to receive a first choke/kill line; at least one first booster hole configured to receive a first booster line; and a plurality of first bolt holes, each first bolt hole comprising a tapered portion and a dowel slot, where each first bolt hole is configured to receive a nut, a bolt, and a dowel; a plurality of bolts, each bolt disposed in a first bolt hole; a plurality of slick nuts equal in number to the plurality of bolts, each slick nut disposed in a first bolt hole; a plurality of dowels equal in number to the plurality of slick nuts, each dowel disposed in a first bolt hole with a slick nut; a second riser assembly comprising: a second main tube; a second flange coupled to the second main tube, the second flange comprising: a central lumen configured to be in fluid communication with the second main tube; at least one second choke/kill hole configured to receive a choke/kill line; at least one second booster hole configured to receive a booster line; a plurality of second bolt holes, each second bolt hole comprising a tapered portion and a dowel slot, where each second bolt hole is configured to receive a nut, a bolt, and a dowel; a plurality of threaded nuts equal in number to the plurality of bolts, each threaded nut disposed in a second bolt hole; and a plurality of dowels equal in number to the plurality of threaded nuts, each dowel disposed in a second bolt hole with a threaded nut; where the first riser assembly is coupled to the second riser assembly via the plurality of bolts such that each bolt is received in a slick nut and is coupled to a threaded nut.

In specific embodiments, the riser string comprises a first bracket coupled to the first riser assembly and a second bracket coupled to the second riser assembly, where each bracket is configured to support at least one choke/kill line and at least one booster line; at least one choke/kill line supported by each bracket and coupled to each flange such that the choke/kill line is received in a choke/kill hole of each flange; and at least one booster line supported by each bracket and coupled to each flange such that the booster line is received in a booster hole of each flange.

The term "coupled" is defined as connected, although not necessarily directly, and not necessarily mechanically.

The terms "a" and "an" are defined as one or more unless this disclosure explicitly requires otherwise.

The term "substantially" is defined as being largely but not necessarily wholly what is specified (and include wholly what is specified) as understood by one of ordinary skill in the art. In any disclosed embodiment, the term "substantially" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a container assembly or composition that "comprises," "has," "includes" or "contains" one or more elements possesses those one or more elements, but is not limited to possessing only those one or more elements. Likewise, an element of a system or composition that "comprises," "has," "includes" or "contains" one or more features possesses those one or more features, but is not limited to possessing only those one or more features.

Furthermore, a structure or composition that is configured in a certain way is configured in at least that way, but may also be configured in ways that are not listed. Metric units may be derived from the English units provided by applying a conversion and rounding to the nearest millimeter.

The feature or features of one embodiment may be applied to other embodiments, even though not described or illustrated, unless expressly prohibited by this disclosure or the nature of the embodiments.

Any embodiment of any of the disclosed container assemblies and compositions can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure may not be labeled in every figure in which that structure appears. Identical reference numbers do not necessarily indicate an identical structure. Rather, the same reference number may be used to indicate a similar feature or a feature with similar functionality, as may non-identical reference numbers.

Unless otherwise noted, the figures are drawn to scale, meaning that the sizes of the depicted items are accurate relative to each other for at least the embodiments depicted in the figures.

DETAILED DESCRIPTION

Various features and advantageous details are explained more fully with reference to the non-limiting embodiments that are illustrated in the accompanying drawings and detailed in the following description. It should be understood, however, that the detailed description and the specific examples, while indicating embodiments of the invention, are given by way of illustration only, and not by way of limitation. Various substitutions, modifications, additions, and/or rearrangements will become apparent to those of ordinary skill in the art from this disclosure.

In the following description, numerous specific details are provided to provide a thorough understanding of the disclosed embodiments. One of ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
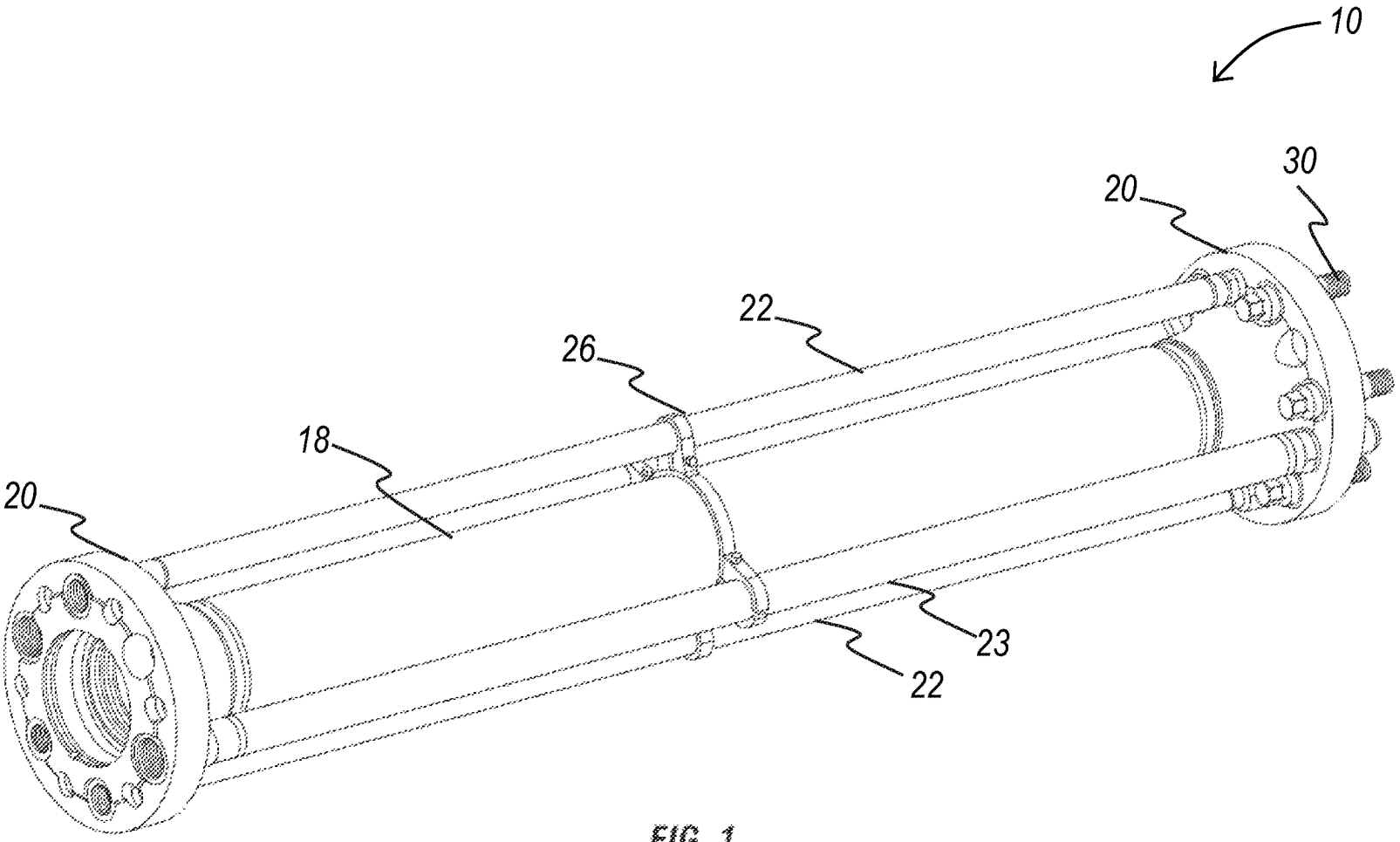
FIG. 1 is a perspective view of an embodiment of a riser assembly.
Figure 2:
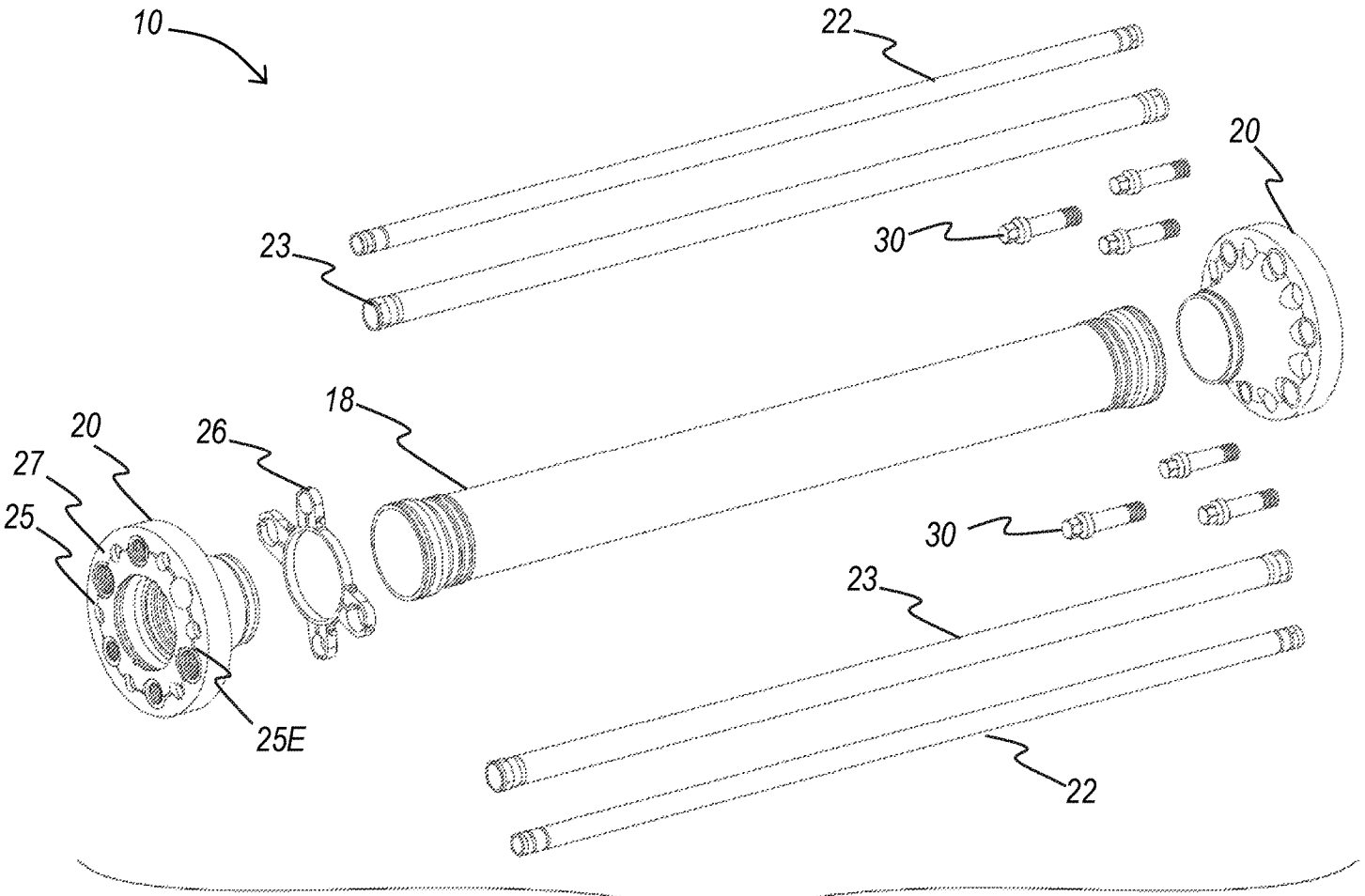
FIG. 2 is an exploded perspective view of the riser assembly of FIG. 1.
Figure 3:
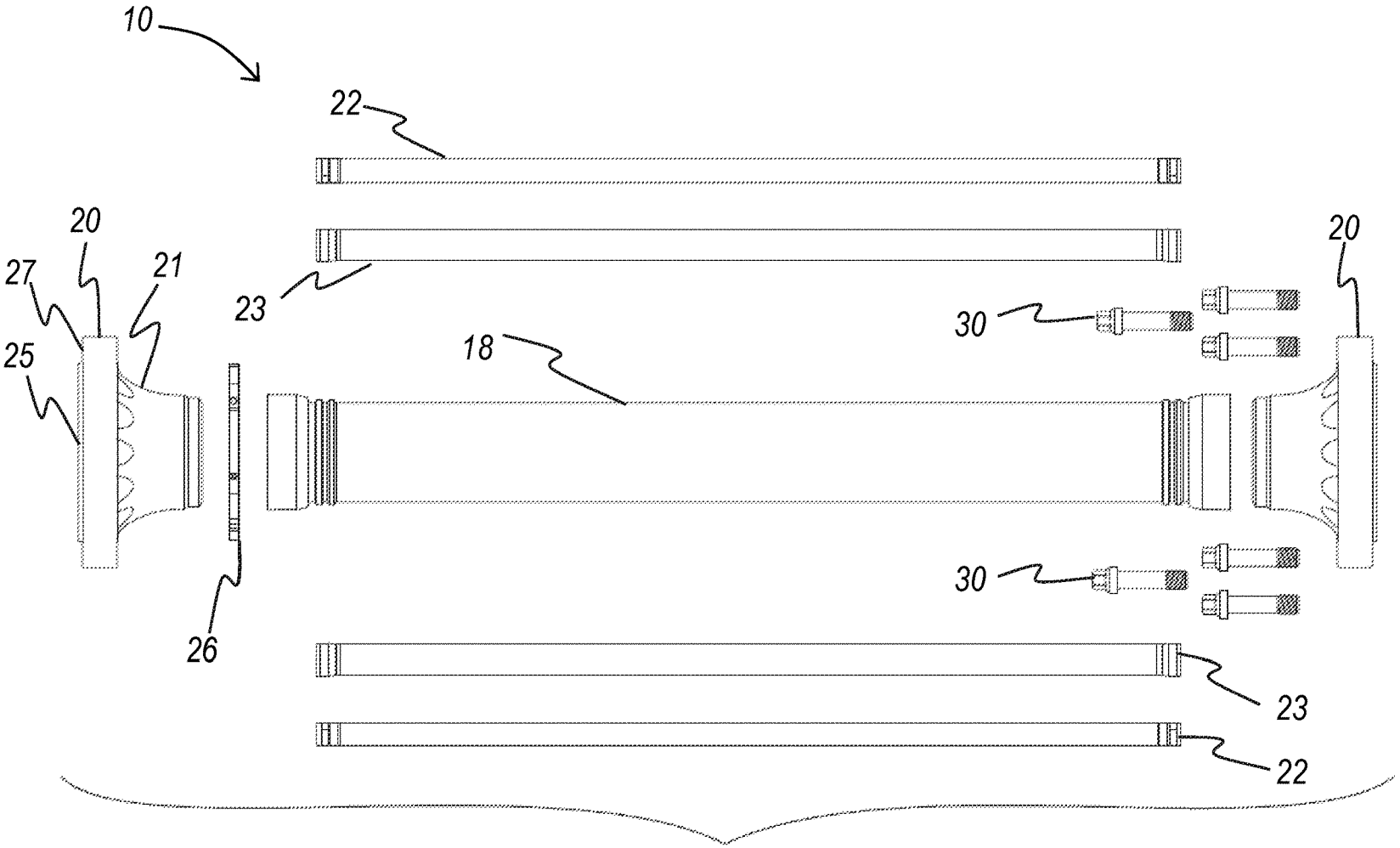
FIG. 3 is a side view of the components of the riser assembly of FIG. 1

FIGS. 1-3 depict an embodiment of a riser assembly 10, which is one example of the present riser assemblies. In the present embodiments, riser assembly 10 comprises a main tube 18 coupled to two flanges 20. Riser assembly 10 comprises a bracket 26 configured to support at least one line coupled to the two flanges. In various embodiments, lines may comprise booster lines 22 (which may be hydraulic lines in certain embodiments) and choke/kill lines 23.

In the illustrated embodiment, riser assembly 10 comprises two booster lines 22 and two choke/kill lines 23, and bracket 26 is configured to support four lines. Other embodiments of riser assembly 10 may be configured to support five or six lines, such as four booster lines 22 and two choke/kill lines 23.

In the illustrated embodiment, riser assembly 10 comprises six bolts 30 configured to be coupled to a flange 20.

Figure 4:
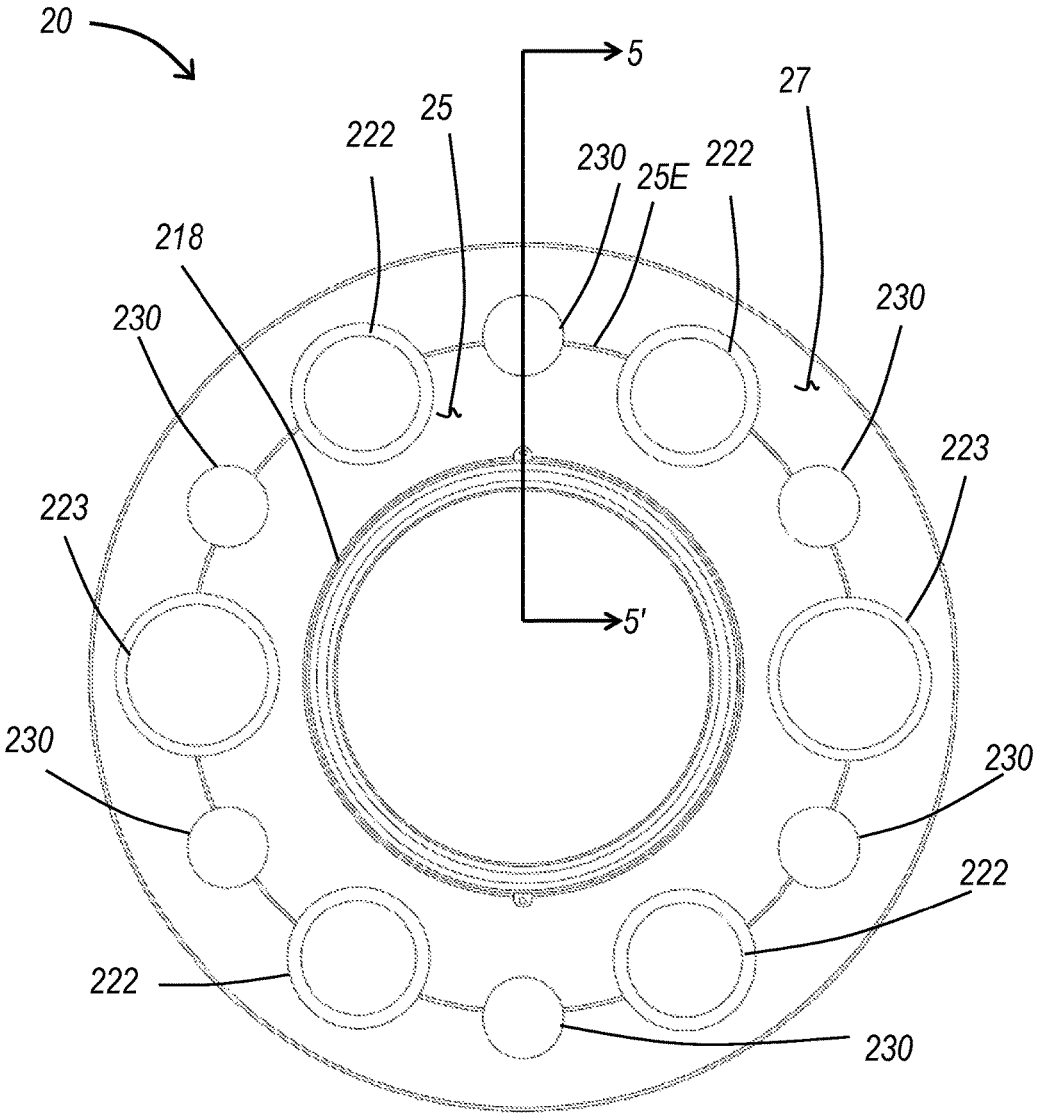
FIG. 4 is an end view of an embodiment of a flange.

FIG. 4 is an end view of a flange 20. The flanges 20 in the illustrated embodiment are substantially identical to one another.

Each flange 20 in the present riser assembly 10 comprises six bolt holes 230, four booster holes 222, and two choke/kill holes 223. Each booster hole 222 is configured to receive a booster line 22. Likewise, each choke/kill hole is configured to receive a choke/kill line 23. central lumen 218 is configured to be in fluid communication with main tube 18. Each bolt hole 230 is configured to receive a bolt 30.

Each bolt hole 230 is about 60° apart from the nearest bolt hole 230 in the illustrated embodiment. Choke/kill holes 223 are about 180° apart in the illustrated embodiment. Booster holes 222 are about 60° apart from each other and about 60° apart from the nearest choke/kill hole 223.

As shown in FIGS. 3 and 4, each flange 20 has a raised inner face 25 and an offset outer face 27. Bolt holes 230, choke/kill holes 223, and booster holes 222 are substantially centered on the edge 25E where raised inner face 25 and offset outer face 23 meet.

Each flange 20 also has an elliptically tapered neck 21. In the embodiment shown, tapered neck 21 is tapered in a 2:1 ratio of long axis to short axis.

The raised face and the elliptically tapered neck operate to reduce bending forces on the bolts when two flanges are coupled together.

Figure 5:
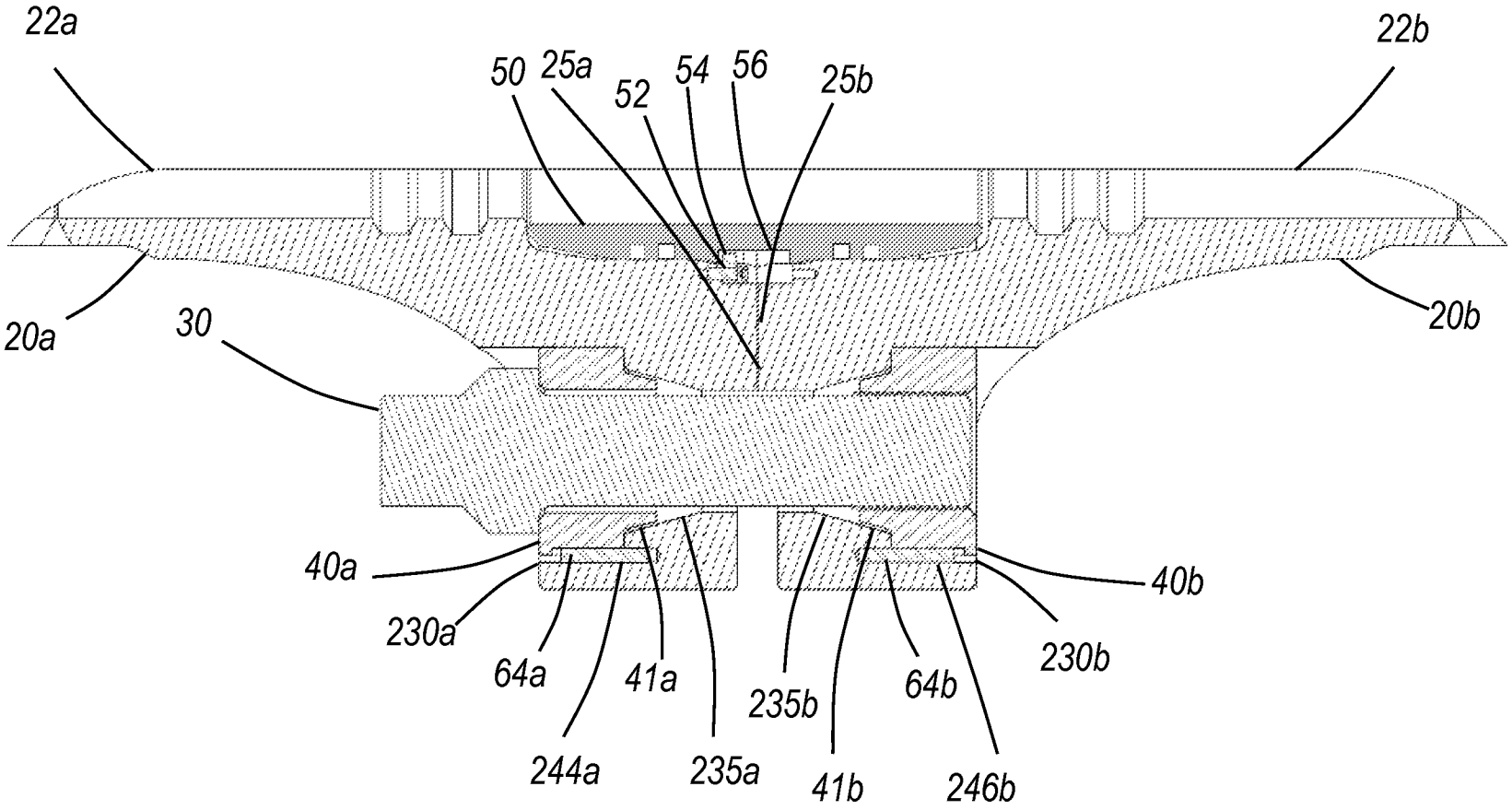
FIG. 5 is a side-section view of two flanges joined to each other.

FIG. 5 is a side sectional view of two flanges joined to each other with a bolt, as when riser assemblies are coupled in a riser string.

As shown in FIG. 5 with further reference to FIGS. 6-9, first flange 20*a* is coupled to second flange 20*b*. First flange 20*a* may include a raised inner face 25*a* and second flange 25*b* may include a raised inner face 25*b*. In the illustrated embodiment, first flange 20*a* is in the "pin up" or "male" configuration, where bolts 30 are coupled to bolt holes 230*a* of flange 20*a* such that the bolts extend beyond the base of flange 20*a* and are configured to be received by second flange 20*b*. Second flange 20*b* is in the "box up" or "female" configuration, where no bolts are inserted into bolt holes 230*b* such that flange 20*b* is configured to receive the bolts 30 coupled to flange 20*a*.

Figure 6:
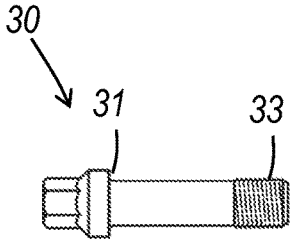
FIG. 6 is a side view of an embodiment of a bolt.

As shown in FIG. 6, each bolt 30 comprises a shoulder portion 31 and a threaded portion 33. Shoulder portion 31 of bolt 30 is configured to limit travel of bolt 30 relative to nut 40 (and specifically the top 45 of nut 40).

Figure 7:
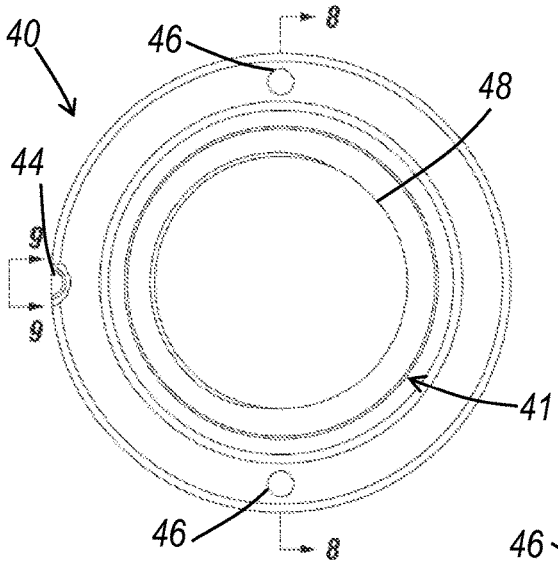
FIG. 7 is a bottom view of an embodiment of a nut.
Figure 8:
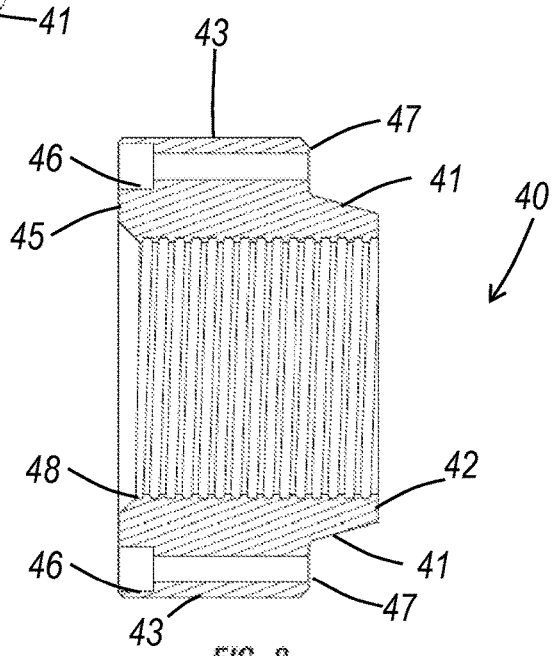
FIG. 8 is a sectional view of the nut of FIG. 7.
Figure 9:
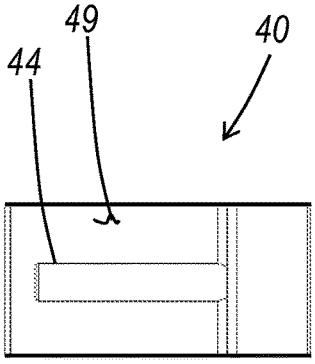
FIG. 9 is a detail view of a slot on the nut of FIG. 7.

As shown in FIGS. 7-9, each nut 40 comprises a top 45, a substantially cylindrical segment 43, a tapered segment 41, and a shoulder 47 between cylindrical segment 43 and tapered segment 41, and a bottom 42. Each nut has two auxiliary bolt holes 46 that extend through the cylindrical segment 43. In the illustrated embodiment, auxiliary bolt holes 46 are countersunk. Auxiliary bolt holes 46 on each nut are configured to be aligned with auxiliary bolt holes on a flange 20 and are further configured to receive a bolt or a screw in some embodiments. The embodiment of nut 40 shown in FIG. 8 comprises internal threads 48 (that is, the nut is a threaded nut). In embodiments where the nut is a slick nut, there are no internal threads.

Further, each nut 40 has a slot 44 configured to receive an anti-rotation dowel. As shown in FIGS. 7 and 9, slot 44 is formed on outer surface 49 of cylindrical segment 43. Slot 44 is configured to receive an anti-rotation dowel configured to prevent nut 40 from rotating. Slot 44 extends from shoulder 47 toward top 45 but does not extend through the thickness of cylindrical segment 43 (that is, the length of the slot 44 is less than the thickness of the cylindrical segment 43).

In addition, nut 40 may be a slick nut (that is, the nut does not comprise any internal threads) or a threaded nut (i.e., at least a portion of the nut comprises internal threads).

Returning to FIG. 5, first nut 40*a* is shown inserted into bolt hole 230*a* and second nut 40*b* is shown inserted into second bolt hole 230*b*. As shown, first nut 40*a* is a slick nut and second nut 40*b* is a threaded nut.

Bolt hole 230*a* comprises a tapered portion 235*a* configured to receive the tapered segment 41*a* of nut 40*a*. Bolt hole 230*a* further comprises a dowel slot 244*a* configured to receive an anti-rotation dowel 64*a*.

Bolt hole 230*b* comprises a tapered portion 235*b* configured to receive the tapered segment 41*b* of nut 40*b*. Bolt hole 230*b* further comprises a dowel slot 244*b* configured to receive an anti-rotation dowel 64*b*. Each anti-rotation dowel is configured to secure its respective nut in place and prevent it from rotating.

In the embodiments discussed above, the nuts are configured to be replaceable when they wear out.

One of skill in the art would recognize that in alternative embodiments, second flange 22*b* could be configured to comprise the bolts 30 (i.e., be configured to be pin up) while first flange 22*a* could be configured to receive the bolts 30 (i.e., be configured to be box up).

Thus, embodiments of a drilling riser assembly that is convertible between a pin up and box up configuration are disclosed.

Further, seal sub 50 is shown coupled to first flange 20*a* via a bolt 52 coupled to flange 20*a* as well as to a seal sub retaining tab 54. Seal sub retaining tab 54 is located in a slot 56 of seal sub 50. In addition, first booster line 22*a* is shown coupled to second booster line 22*b*.

Multiple flanges of multiple riser assemblies may be coupled to one another as disclosed above to form a riser string. In a riser string, like elements are typically configured to be in fluid communication with one another. For example, choke/kill lines, booster lines, and the main lines are configured to be in fluid communication along the length of the riser string.

The above specification and examples provide a complete description of the structure and use of an exemplary embodiment. Although certain embodiments have been described above with a certain degree of particularity, or with reference to one or more individual embodiments, those skilled in the art could make numerous alterations to the disclosed embodiments without departing from the scope of this invention. As such, the illustrative embodiment of the present devices is not intended to be limited to the particular forms disclosed. Rather, they include all modifications and alternatives falling within the scope of the claims, and embodiments other than the one shown may include some or all of the features of the depicted embodiment. For example, components may be combined as a unitary structure and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not to be interpreted as including means-plus- or step-plus-function limitations, unless such a limitation is explicitly recited in a given claim using the phrase(s) "means for" or "step for," respectively.

The invention claimed is:

1. A riser assembly comprising:

a main tube;

two flanges coupled to the main tube, each flange comprising:

a raised inner face;

an offset outer face adjacent to the raised inner face and forming an edge between the raised inner face and the offset outer face;

a central lumen configured to be in fluid communication with the main tube;

at least one choke/kill hole configured to receive a choke/kill line;

at least one booster hole configured to receive a booster line; and a plurality of bolt holes, each bolt hole comprising a tapered portion and a dowel slot, where each bolt hole is configured to receive a nut, a bolt, and a dowel;

where the edge between the raised inner face and the offset outer face lies on a circle that passes through a radial center of each of the bolt holes.

2. The riser assembly of claim 1, further comprising:

a plurality of bolts;

a plurality of slick nuts equal in number to the plurality of bolts, where each nut comprises:

a cylindrical section comprising an outer surface;

a tapered section; and a shoulder between the cylindrical section and the tapered section;

where each nut further comprises a slot in the outer surface; and a plurality of dowels equal in number to the plurality of nuts.

3. The riser assembly of claim 2, comprising six bolts.

4. The riser assembly of claim 1, further comprising:

a plurality of threaded nuts equal in number to the plurality of bolts, where each nut comprises:

a cylindrical section comprising an outer surface;

a tapered section; and a shoulder between the cylindrical section and the tapered section;

where each nut further comprises a slot in the outer surface; and a plurality of dowels equal in number to the plurality of nuts.

5. The riser assembly of claim 4, comprising six nuts.

6. The riser assembly of claim 1, further comprising a choke/kill line coupled to each flange such that the choke/kill line is received in a choke/kill hole of each flange.

7. The riser assembly of claim 1, further comprising a booster line coupled to each flange such that the booster line is received in a booster hole of each flange.

8. The riser assembly of claim 1, further comprising:

a bracket configured to support at least one choke/kill line and at least one booster line;

at least one choke/kill line supported by the bracket and coupled to each flange such that the choke/kill line is received in a choke/kill hole of each flange; and at least one booster line supported by the bracket and coupled to each flange such that the booster line is received in a booster hole of each flange.

9. The riser assembly of claim 1, where the edge extends circumferentially around the central lumen.

10. The riser assembly of claim 1, where the raised inner face is configured to be in direct contact with a surface of a flange of an adjacent riser segment and the offset outer face is configured to be axially spaced apart from any surface of a flange of an adjacent riser segment.

11. A riser string comprising:

a first riser assembly comprising:

a first main tube;

a first flange coupled to the first main tube, the first flange comprising:

a first raised inner face;

a first offset outer face adjacent to the first raised inner face and forming a first edge between the first raised inner face and the first offset outer face;

a first central lumen configured to be in fluid communication with the first main tube;

at least one first choke/kill hole configured to receive a first choke/kill line;

at least one first booster hole configured to receive a first booster line; and a plurality of first bolt holes, each first bolt hole comprising a tapered portion and a dowel slot, where each first bolt hole is configured to receive a nut, a bolt, and a dowel;

a plurality of bolts, each bolt disposed in a first bolt hole;

a plurality of slick nuts equal in number to the plurality of bolts, each slick nut disposed in a first bolt hole;

a plurality of dowels equal in number to the plurality of slick nuts, each dowel disposed in a first bolt hole with a slick nut;

where the first edge between the first raised inner face and the first offset outer face lies on a circle that passes through a radial center of each of the first bolt holes;

a second riser assembly comprising:

a second main tube;

a second flange coupled to the second main tube, the second flange comprising:

a second raised inner face;

a second offset outer face adjacent to the second raised inner face and forming a second edge between the second raised inner face and the second offset outer face;

a second central lumen configured to be in fluid communication with the second main tube;

at least one second choke/kill hole configured to receive a choke/kill line;

at least one second booster hole configured to receive a booster line;

a plurality of second bolt holes, each second bolt hole comprising a tapered portion and a dowel slot, where each second bolt hole is configured to receive a nut, a bolt, and a dowel;

a plurality of threaded nuts equal in number to the plurality of bolts, each threaded nut disposed in a second bolt hole; and a plurality of dowels equal in number to the plurality of threaded nuts, each dowel disposed in a second bolt hole with a threaded nut;

where the second edge between the second raised inner face and the second offset outer face lies on a circle that passes through a radial center of each of the second bolt holes;

where the first riser assembly is coupled to the second riser assembly via the plurality of bolts such that each bolt is received in a slick nut and is coupled to a threaded nut, and the first inner face contacts the second inner face.

12. The riser string of claim 11, further comprising six bolts.

13. The riser string of claim 11, further comprising a choke/kill line coupled to a first choke/kill hole and a second choke/kill hole.

14. The riser string of claim 11, further comprising a booster line coupled to a first booster hole and a second booster hole.

15. The riser assembly of claim 11, further comprising:

a first bracket coupled to the first riser assembly and a second bracket coupled to the second riser assembly, where each bracket is configured to support at least one choke/kill line and at least one booster line;

at least one choke/kill line supported by each bracket and coupled to each flange such that the choke/kill line is received in a choke/kill hole of each flange; and at least one booster line supported by each bracket and coupled to each flange such that the booster line is received in a booster hole of each flange.

16. The riser string of claim 11, where the first edge extends circumferentially around the first central lumen and the second edge extends circumferentially around the second central lumen.

17. The riser assembly of claim 11, where the first offset outer face is axially spaced apart from the second offset outer face.

18. A riser assembly comprising:

a main tube;

two flanges coupled to the main tube, each flange comprising:

a raised inner face;

an offset outer face adjacent to the raised inner face and forming an edge between the raised inner face and the offset outer face;

a central lumen configured to be in fluid communication with the main tube;

at least one choke/kill hole configured to receive a choke/kill line;

at least one booster hole configured to receive a booster line; and a plurality of bolt holes, each bolt hole comprising a tapered portion and a dowel slot, where each bolt hole is configured to receive a nut, a bolt, and a dowel;

where the edge intersects each of the bolt holes.

* * * * *